United States Patent [19]

Meisner

[11] 4,450,785

[45] May 29, 1984

[54] APPARATUS FOR COATING OBJECTS ELECTROSTATICALLY

[75] Inventor: Roland A. Meisner, Schorndorf, Fed. Rep. of Germany

[73] Assignee: BASF Farben +Fasern AG, Hamburg, Fed. Rep. of Germany

[21] Appl. No.: 474,275

[22] Filed: Mar. 17, 1983

Related U.S. Application Data

[63] Continuation of Ser. No. 234,193, Feb. 13, 1981, abandoned.

[30] Foreign Application Priority Data

Feb. 15, 1980 [DE] Fed. Rep. of Germany ..... 3005678

[51] Int. Cl.[3] ..... B05B 5/02; B05C 5/02

[52] U.S. Cl. ..... 118/626; 239/223; 239/224; 239/700; 239/703

[58] Field of Search ..... 118/626, 621; 239/700, 239/703, 223, 224

[56] References Cited

U.S. PATENT DOCUMENTS

| | | | |
|---|---|---|---|
| 2,893,894 | 7/1959 | Ransburg | 118/626 |
| 3,057,558 | 10/1962 | Verba et al. | 239/214.25 |
| 3,085,749 | 4/1963 | Schweitzer et al. | 239/224 |
| 4,037,561 | 7/1977 | La Fave et al. | 118/626 |
| 4,214,708 | 7/1980 | Lacchia | 229/224 |
| 4,275,838 | 6/1981 | Fangmeyer | 118/626 |

FOREIGN PATENT DOCUMENTS

| | | | |
|---|---|---|---|
| 973478 | 2/1960 | Fed. Rep. of Germany | 118/626 |

*Primary Examiner*—S. L. Childs
*Attorney, Agent, or Firm*—Wells & Wells

[57] ABSTRACT

An apparatus for electrostatically coating an object using electrostatically charged powder grains. The invention improves upon the spray bell sprayer by having a fixed hollow shaft providing a central supply line for the powder grains, the spray bell rotates about the hollow shaft and a plurality of compressed air nozzles pass radially into the hollow shaft.

8 Claims, 2 Drawing Figures

APPARATUS FOR COATING OBJECTS ELECTROSTATICALLY

This application is a continuation of application Ser. No. 234,193, filed 2/13/81, abandoned.

The invention relates to a process for electrostatically coating objects by means of electrostatically charged powder grains and feeding a mixture of powder and air into a spray bell, fanning out the flow of the powder-air mixture and flinging the powder particles off the spray head, and conveying the powder particles onto the object to be treated by applying an electric field between the spray bell and the object.

Numerous processes and means for electrostatically coating objects with a powder are known. Thus there are spray systems wherein the powders are fed by means of compressed air as a mixture of air and powders. This mixture of powder and air is fanned out by means of an inhomogeneity (impact body), then it is moved in part by the residual momentum of the powder grain, in part by the electric forces which act on a charged powder grain in an electric field, to the object to be coated. The charging of the powder grain is implemented either within the spray system or outside it.

Moreover systems are known, in which a spin is imparted to the mixture of air and powder while still within the spray system. After the flow of particles leaves the spray system, this spin then fans out said flow.

A powder spray disk is known for use in special cases, for which a fluidized flow of powder is incident at given angles on a rotating nearly vertical disk with bucket-shaped offsets, said flow then being flung off radially due to centrifugal force. The charging and the transportation of the particles to the object then is carried out in known manner. The drawback of this method is essentially its restricted applicability.

The drawbacks of the known methods are in the lack of process controllability, in the undefined frictional charging due to high speeds, and in the high susceptibility to wear and possibly sintering tendency.

SUMMARY OF THE INVENTION

It is the object of the invention to create a process for electrostatically coating objects by means of a powder in such a manner as to avoid undefined frictional charging, keep slight the wear and eliminate the susceptibility to sintering, and simultaneously achieving good process control.

The problem basic to the invention is resolved in that a fluidized flow of powder, i.e. a flowable mixture of air and powder, is slowly fed to the spray bell, then is minimally accelerated when passing into the rotating bell and next is accelerated together with the bell to 500 to 6,000 rpm, moved to the rim of the bell and then is centrifuged off.

The apparatus to carry out this process is characterized by a bell which rotates about a fixed axis and provided with a central intake for the supply of powder flow, said intake comprising a number of compressed air nozzles.

Further advantageous embodiments are discussed in the dependent claims.

Thus the process of the invention operates with a bell acting as the high-voltage electrode and with compressed air additionally, the flow of the mass of the fluidized powder being fed to the bell which is rotating preferably at 500 to 6,000 rpm. This mass flow is sucked in by the bell, which is designed in the manner of a compressor, and is conveyed in locked manner to the edge of the bell where it is flung off depending on the geometric and kinematic parameters of the bell. By changing the aspiration condition, for instance by introducing compressed air and/or varying the angular speed, the mass flow rate and the geometry of the powder clouds can be changed. The powder grain moreover passes through an annular air sheet to control the axial momentum. The position of the axis of spin is subject to no restrictions.

In the apparatus of the invention, the fluidized flow of powder is fed to the bell through the fixed hollow shaft in the area of the least relative speed and the least centrifugal acceleration. Nozzle bores are arranged in rearwardly offset manner in one or more arcs of circles of which one preferably is larger than the diameter of the centrifugal rim. The diameter of the arc of circle and the bore geometry are so selected in relation to the air flow rate that the air supply around the rotating bell will be assured and that the sprayed off powder cone receives an axial thrust defined by the annular air sheet. The bell provided by the invention may be driven selectively pneumatically or electrically. If an electric motor is used, it will be fed from high potential through an isolation transformer. Advantageously an asynchronous motor will be used as the electric motor, of which the angular speed can be controlled by changing the frequency of synchronism.

BRIEF DESCRIPTION OF THE DRAWINGS

An illustrative example of the invention is discussed below in relation to the drawings.

DESCRIPTION OF THE PREFERRED EMBODIMENTS

Figure 1:
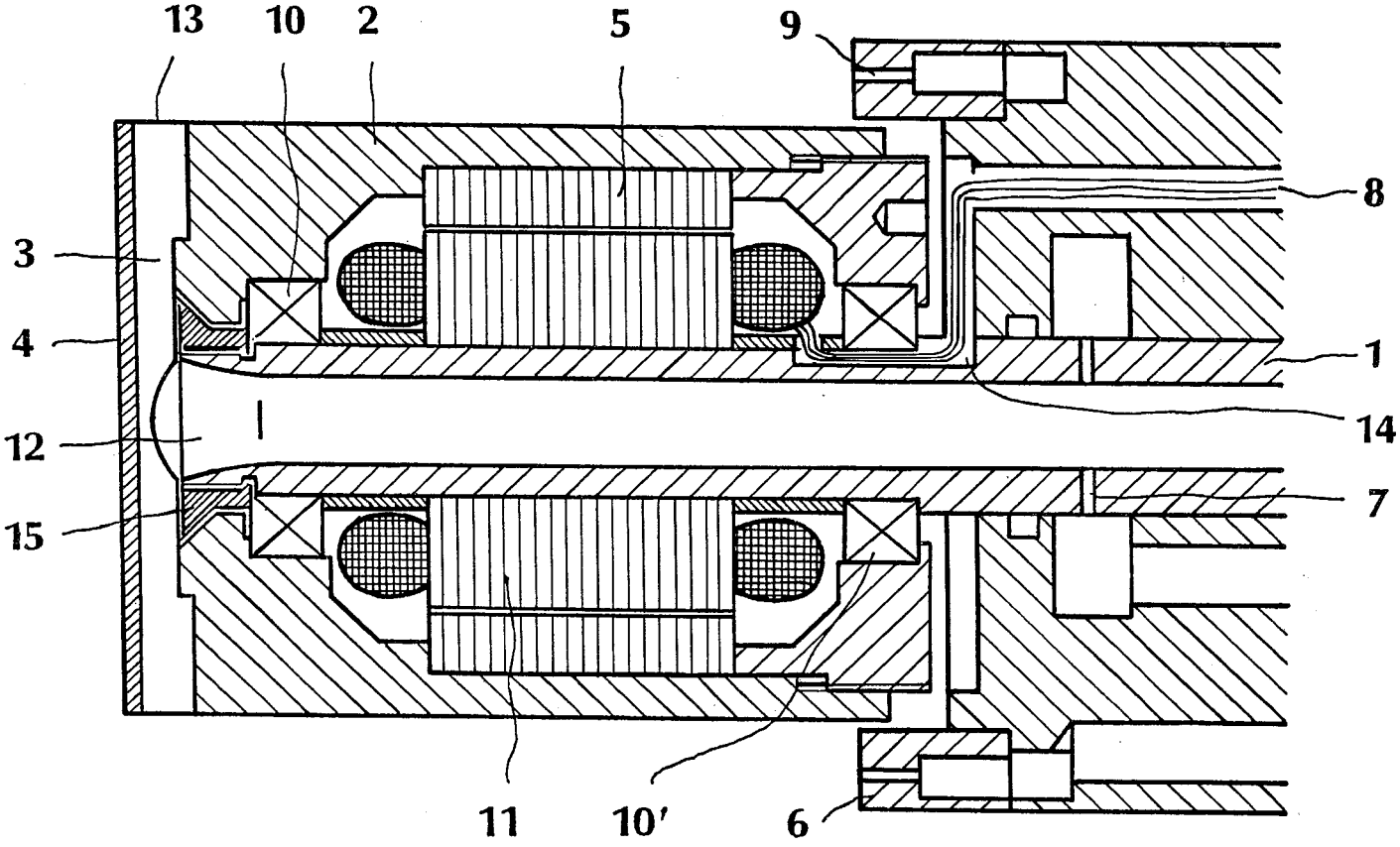
FIG. 1 is a longitudinal section of the apparatus of the invention.

The embodiment shown in longitudinal section in FIG. 1 shows the hollow shaft 1 supporting the bearings 10,10' of the bell 2 with rotor 5, stator 11 of the drive motor and the dynamic seal 15.

The electrical feed line 8 for the stator 11 passes through a groove 14 of the hollow shaft and through the bearing 10'. The hollow shaft terminates in a diffusor 12 which returns the fluidized powder directly to the suction rim of the moving blades 3 of the bell compressor. The plate 4 prevents an incident flow by the bell compressor from the half space located in front of the bell. The ratio of air to fluidized powder can be controlled by the radial nozzle ring 7, so that if need be the powder supply can be interrupted. The nozzle bores 9 of the nozzle ring 6 generate a circular air sheet imparting an axial thrust to the sheet of powder centrifuged off the rim 13.

Figure 2:
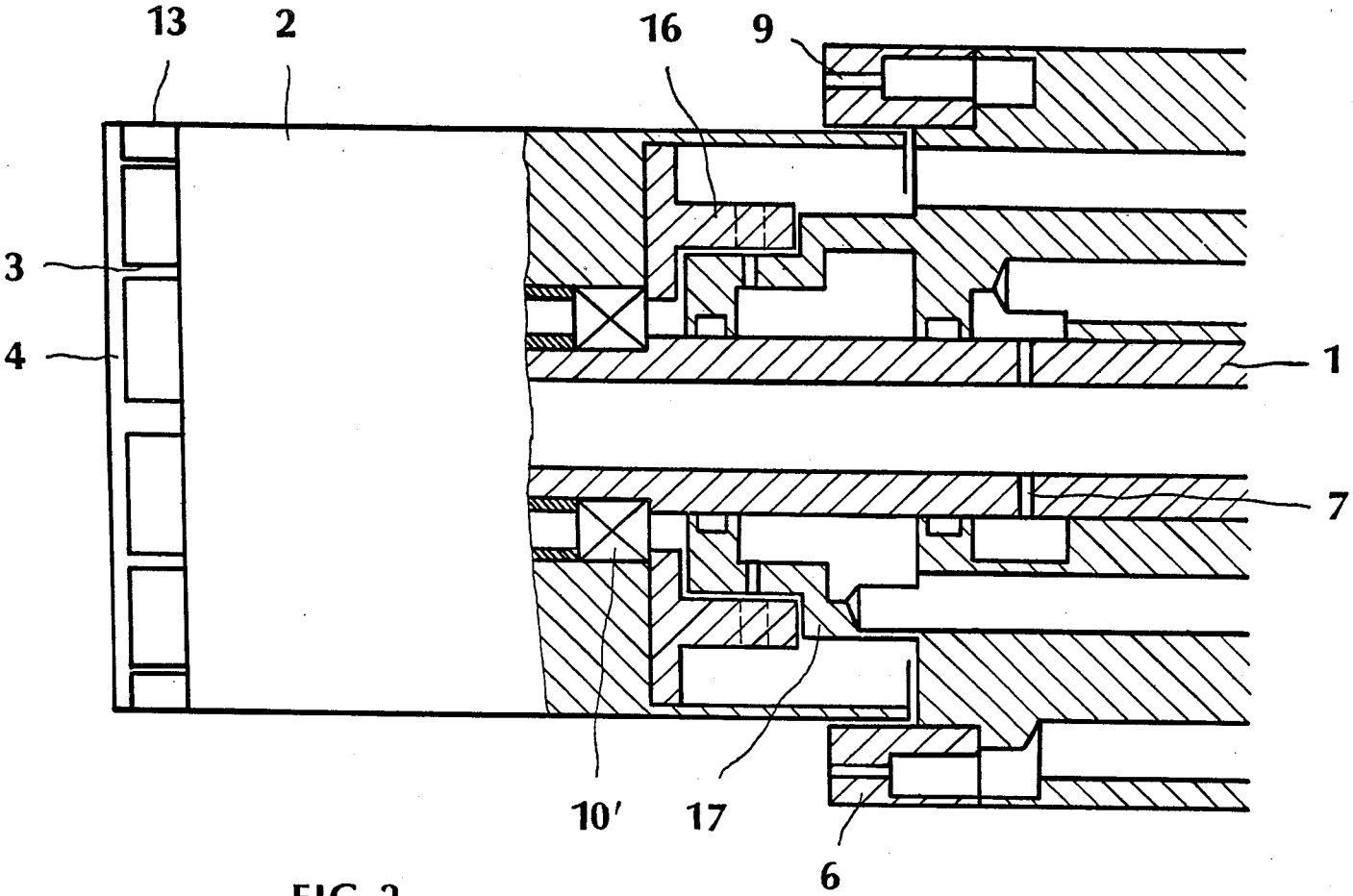
FIG. 2 is a modified embodiment of FIG. 1.

The embodiment shown in FIG. 2 merely differs from that in FIG. 1 in that a turbine drive with rotor 16 and nozzle ring 17 is provided in lieu of an electric drive.

Embodiments of the apparatus include:

(a) a bell (2) rotating about a fixed shaft and equipped with a central supply line for the supply of the powder comprising a number of compressed-air nozzles;

(b) an external rotor motor (5,11) for the bell, which is designed as an electrical motor;

(c) a compressed-air turbine (16,17) acting as the external rotor motor;

(d) the bell inside contour is provided with air blades;

(e) the air blades are covered at the front by a plate (4);

(f) the motor bearing space is separated by a dynamic seal from the powder space;

(g) the electric motor is hooked up to high voltage and operated through an isolation transformer; and (h) the angular speed of the motor is changed by varying the synchronous frequency.

I claim:

1. In an apparatus for electrostatically coating an object using electrostatically charged powder grains, comprising:

(a) means for feeding an air-powder mixture to a spray bell having a spray head;

(b) means on said spray bell for fanning out the flow of said air-powder mixture;

(c) means for centrifuging said powder grains off said spray head;

(d) means for applying an electric field between said spray bell and said object and (e) means for conveying said powder grains onto said object to be treated;

the improvement comprising:

(f) a fixed hollow shaft (1) defining a central supply line for fluidized flow of said air-powder mixture and said means for feeding:

(g) said spray bell (2) adapted for rotation about said hollow shaft and sucking said fluidized flow;

(h) a plurality of first compressed air nozzles (7) passing radially into said hollow shaft for control of said fluidized flow; and (i) further comprising a nozzle ring (6) having a plurality of second compressed air nozzles (9) positioned parallel to said hollow shaft and defining said means on said spray bell for fanning out.

2. The apparatus of claim 1, said bell having an external rotor motor (5,11) comprising an electric motor.

3. The apparatus of claim 1, said bell having an external rotor motor (16,17) comprising a compressed air turbine.

4. The apparatus of claim 1, wherein said bell has an inside contour provided with continuous air blades.

5. The apparatus of claim 4, wherein said air blades are covered at the front by a plate (4).

6. The apparatus of claim 1, having a motor bearing space, a powder space and a dynamic seal separating said spaces.

7. The apparatus of claim 2, wherein said electric motor is hooked up to high voltage and operated through an isolation transformer.

8. The apparatus of claim 7, wherein angular speed of said motor is changed by means of varying synchronous frequency.

* * * * *